US009068402B2

(12) United States Patent
Boisjolie et al.

(10) Patent No.: US 9,068,402 B2
(45) Date of Patent: Jun. 30, 2015

(54) DRILLING MUD RECOVERY SYSTEM

(71) Applicant: Cameron International Corporation, Houston, TX (US)

(72) Inventors: Roger D. Boisjolie, Houston, TX (US); Paul L. Tasson, Houston, TX (US); David L. Gilmore, Houston, TX (US); William F. Puccio, Katy, TX (US)

(73) Assignee: Cameron International Corporation, Houston, TX (US)

( * ) Notice: Subject to any disclaimer, the term of this patent is extended or adjusted under 35 U.S.C. 154(b) by 82 days.

(21) Appl. No.: 13/840,387

(22) Filed: Mar. 15, 2013

(65) Prior Publication Data

US 2014/0262315 A1 Sep. 18, 2014

(51) Int. Cl.

| | |
|---|---|
| ***E21B 17/01*** | (2006.01) |
| ***E21B 19/00*** | (2006.01) |
| ***E21B 17/07*** | (2006.01) |
| ***E21B 21/00*** | (2006.01) |

(52) U.S. Cl.

CPC ..... *E21B 17/01* (2013.01); *E21B 19/006* (2013.01); *E21B 17/07* (2013.01); *E21B 21/003* (2013.01)

(58) Field of Classification Search

None

See application file for complete search history.

(56) References Cited

U.S. PATENT DOCUMENTS

| | | | | |
|---|---|---|---|---|
| 3,256,936 A | | 6/1966 | Johnson et al. | |
| 4,712,620 A | * | 12/1987 | Lim et al. | 166/355 |
| 5,228,506 A | * | 7/1993 | Pearce | 166/81.1 |
| 5,394,939 A | * | 3/1995 | Walker | 166/81.1 |
| 7,409,995 B2 | * | 8/2008 | Moynahan | 166/311 |

FOREIGN PATENT DOCUMENTS

| | | |
|---|---|---|
| EP | 1319800 | 6/2003 |
| GB | 2316108 | 2/1998 |
| WO | 01/86112 | 11/2001 |
| WO | 2012/140446 | 10/2012 |

OTHER PUBLICATIONS

Wagner, Search report and written opinion from Intellectual Property Office of Singapore for Application No. 10201400579T (dated Nov. 5, 2014, and mailed by IPOS to Applicant on Dec. 15, 2014).

* cited by examiner

*Primary Examiner* — Matthew Buck

*Assistant Examiner* — Douglas S Wood

(74) *Attorney, Agent, or Firm* — Eubanks PLLC

(57) ABSTRACT

A fluid recovery system is provided. In one embodiment, the fluid recovery system includes a telescoping joint of a marine riser having an inner barrel and an outer barrel configured to extend and retract with respect to one another when installed as part of the marine riser. A drip pan is coupled to the outer barrel to enable the drip pan to catch fluid, such as drilling mud, leaking from the telescoping joint between the inner barrel and the outer barrel. In this embodiment, the fluid recovery system also includes a pump and a return conduit that are coupled to enable the pump to pump caught fluid from the drip pan back into the telescoping joint via the return conduit. Additional systems, devices, and methods are also disclosed.

20 Claims, 6 Drawing Sheets

DRILLING MUD RECOVERY SYSTEM

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource.

Offshore drilling systems typically include a marine riser that connects a drilling rig to subsea wellhead equipment, such as a blowout preventer stack connected to a wellhead. A drill string may be run from the drilling rig through the marine riser into the well. Drilling mud may be routed into the well through the drill string and back up to the surface in the annulus between the drill string and the marine riser. As will be appreciated, a floating offshore drilling rig can experience forces (e.g., from waves or wind) that cause the drilling rig to move position with respect to the well. For this reason, marine risers often include various components that allow the marine riser to accommodate such motion. For example, marine risers may include flex joints that enable the riser to pivot within an angular range to accommodate lateral motion of the drilling rig on the surface. Marine risers may also include telescoping joints that expand and contract to compensate for vertical motion (or heave) of the drilling rig.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Embodiments of the present disclosure generally relate to a drilling mud recovery system for a marine riser. In one embodiment, the drilling mud recovery system is provided on a telescoping joint of a marine riser and includes a reservoir to catch drilling mud (or other fluids) that leak from the telescoping joint. The drilling mud caught with the reservoir may then be routed away from the reservoir through a return conduit and recycled in a drilling system. In one embodiment, the caught drilling mud is recycled by pumping it through a return conduit from the reservoir to mud circulation equipment on a drilling rig. In another embodiment, the caught drilling mud is instead routed from the reservoir through a return conduit into the telescoping joint, allowing the caught drilling mud to return to the drilling rig through the marine riser.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Figure 1:
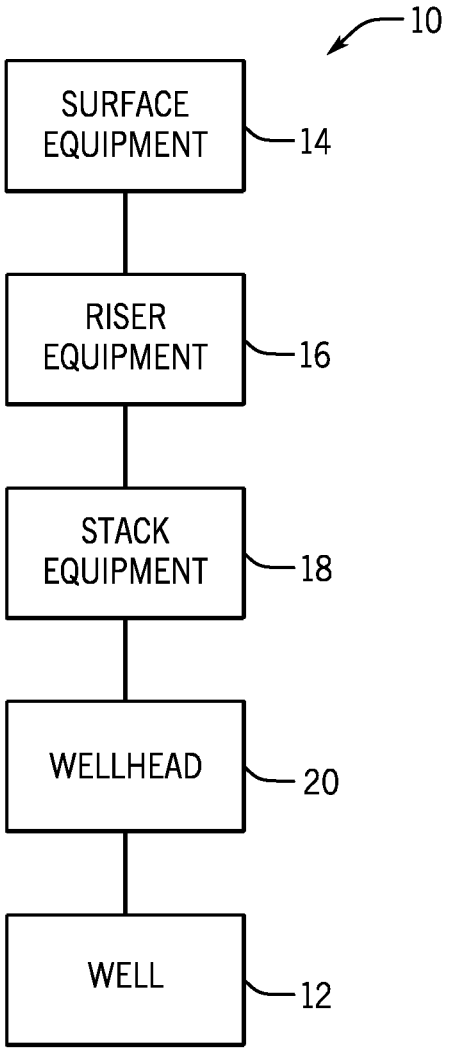
FIG. 1 generally depicts components of a subsea system (e.g., a drilling system) for accessing or extracting a natural resource via a well in accordance with an embodiment of the present disclosure.

Turning now to the present figures, a system 10 is illustrated in FIG. 1 in accordance with one embodiment. Notably, the system 10 (e.g., a drilling system or a production system) facilitates accessing or extraction of a resource, such as oil or natural gas, from a well 12. As depicted, the system 10 is a subsea system that includes surface equipment 14, riser equipment 16, and stack equipment 18, for accessing or extracting the resource from the well 12 via a wellhead 20. In one subsea drilling application, the surface equipment 14 is provided on a drilling rig above the surface of the water, the stack equipment 18 (i.e., a wellhead assembly) is coupled to the wellhead 20 at the sea floor, and the riser equipment 16 connects the stack equipment 18 to the surface equipment 14.

As will be appreciated, the surface equipment 14 may include a variety of devices and systems, such as pumps, power supplies, cable and hose reels, control units, a diverter, a gimbal, a spider, and the like. The stack equipment 18, in turn, may include a number of components, such as blowout preventers, that enable the control of fluid from the well 12. Similarly, the riser equipment 16 may also include a variety of components, such as riser joints, flex joints, fill valves, control units, and a pressure-temperature transducer, some of which are depicted in FIG. 2 in accordance with one embodiment.

Figure 2:
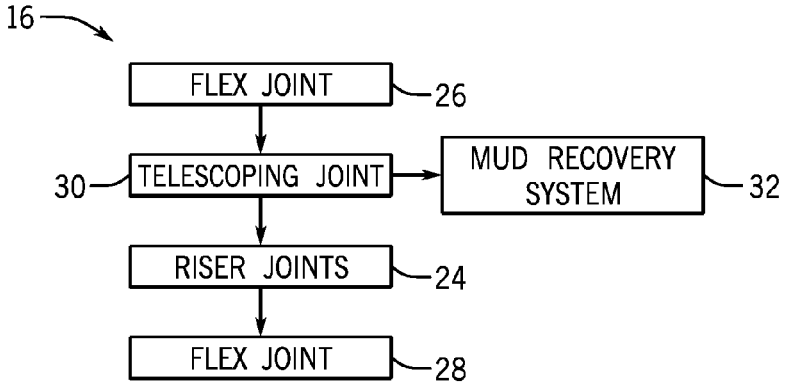
FIG. 2 is a block diagram of various components of the riser equipment of FIG. 1, including a drilling mud recovery system, in accordance with one embodiment.

Particularly, in FIG. 2 the riser equipment 16 includes riser joints 24 that facilitate the connection of the surface equipment 14 to the stack equipment 18. In some offshore drilling applications, the surface equipment 14 is mounted on a floating rig (e.g., a semisubmersible or a drillship) above the well 12. Waves or other forces on the floating rig can cause the surface equipment 14 to move with respect to the stack equipment 18 and the well 12.

To accommodate this relative motion, the riser equipment 16 in FIG. 2 includes an upper flex joint 26, a lower flex joint 28, and a telescoping joint 30. The upper flex joint 26 can be connected to or near the surface equipment 14 and the lower flex joint 28 can be coupled to or near the stack equipment 18. These flex joints 26 and 28 allow angular displacement of the riser string (including the riser joints 24 and the telescoping joint 30) and accommodate lateral motion of the floating rig on the water's surface above the stack equipment 18. The floating rig can also include a dynamic positioning system that tracks (e.g., via a global positioning system) the position of the rig with respect to the well 12 and automatically controls propulsion of the rig to return it to a desired location over the well 12. Complementing the flex joints 26 and 28, the telescoping joint 30 compensates for heave (i.e. up-down motion) of the drilling rig generally caused by waves at the surface. As discussed in greater detail below, the telescoping joint includes inner and outer barrels that slide with respect to one another to enable the telescoping joint to extend and retract.

At various operational stages of the system 10, fluid can be transmitted between the well 12 and the surface equipment 14 through the riser equipment 16. For example, during drilling, a drill string is run from the surface, through a riser (e.g., through the flex joints 26 and 28, the telescoping joint 30, and a series of connected riser joints 24), and into the well 12 to bore a hole in the seabed. Drilling fluid (also known as drilling mud) is circulated down into the well 12 through the drill string to remove well cuttings, and this fluid returns to the surface through the annulus between the drill string and the riser. As noted above, the telescoping joint 30 includes sliding members that compensate for heave of a floating rig with respect to the well 12. But in some instances drilling mud returning to the surface through the riser can leak from the telescoping joint 30. Thus, the riser equipment 16 is depicted in FIG. 2 as including a mud recovery system 32 for capturing and recycling leaked drilling mud back into system 10.

Figure 3:
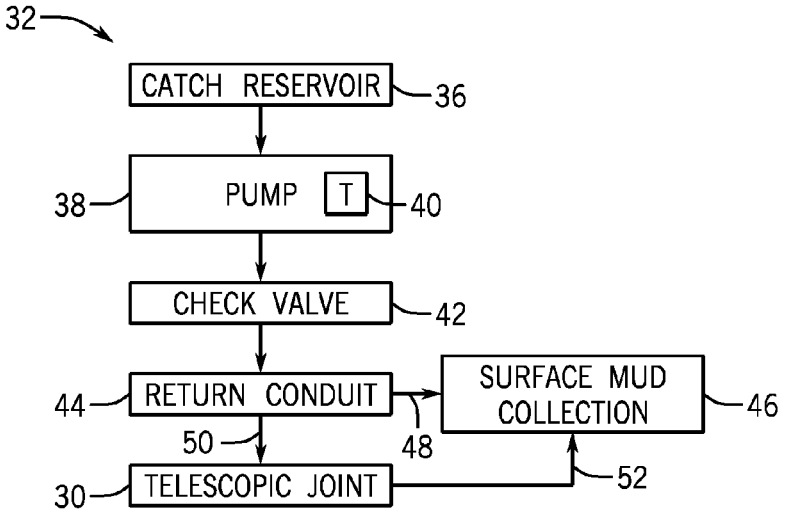
FIG. 3 is a block diagram of various components of the drilling mud recovery system of FIG. 2 in accordance with certain embodiments.

In accordance with certain embodiments, the mud recovery system 32 depicted in FIG. 3 includes a reservoir (which may also be referred to as a catch reservoir or a drip pan) to catch drilling mud (or other fluid) that leaks out of the riser string through the telescoping joint 30. A pump 38 draws fluid caught within the reservoir 36 and transmits the fluid back into the system 10 via a return conduit 44. In one embodiment, the pump 38 is a progressive cavity pump. But it is noted that any other types of pumps could instead be used. Further, the pump 38 can be powered in any suitable manner, such as hydraulically, pneumatically, or electrically. In some embodiments, such as that depicted in FIG. 3, the pump 38 includes a temperature sensor 40 that controls operation of the pump 38 (e.g., deactivates the pump if the temperature is too high). In other embodiments, the pump 38 may be operated continuously or continually, as desired (such as based on the level of fluid within the reservoir 36).

The depicted mud recovery system 32 also includes a check valve 42 to inhibit fluid within the return conduit 44 from flowing back into the reservoir 36. In some instances, the return conduit 44 can route fluid from the reservoir 36 to surface mud collection equipment 46 (e.g., a tank on the drilling floor of a floating rig), as generally indicated by reference numeral 48. It is noted that pumping leaked drilling mud from a pan through a separate return conduit up to surface mud collection equipment is known in the prior art. But in contrast to pumping such fluid up to the surface through the return conduit 44, in certain embodiments of the present technique the return conduit 44 instead routes the fluid from the reservoir 36 directly (i.e., without first returning the fluid to the surface) into the telescoping joint 30, as generally indicated by reference numeral 50.

Figure 4:
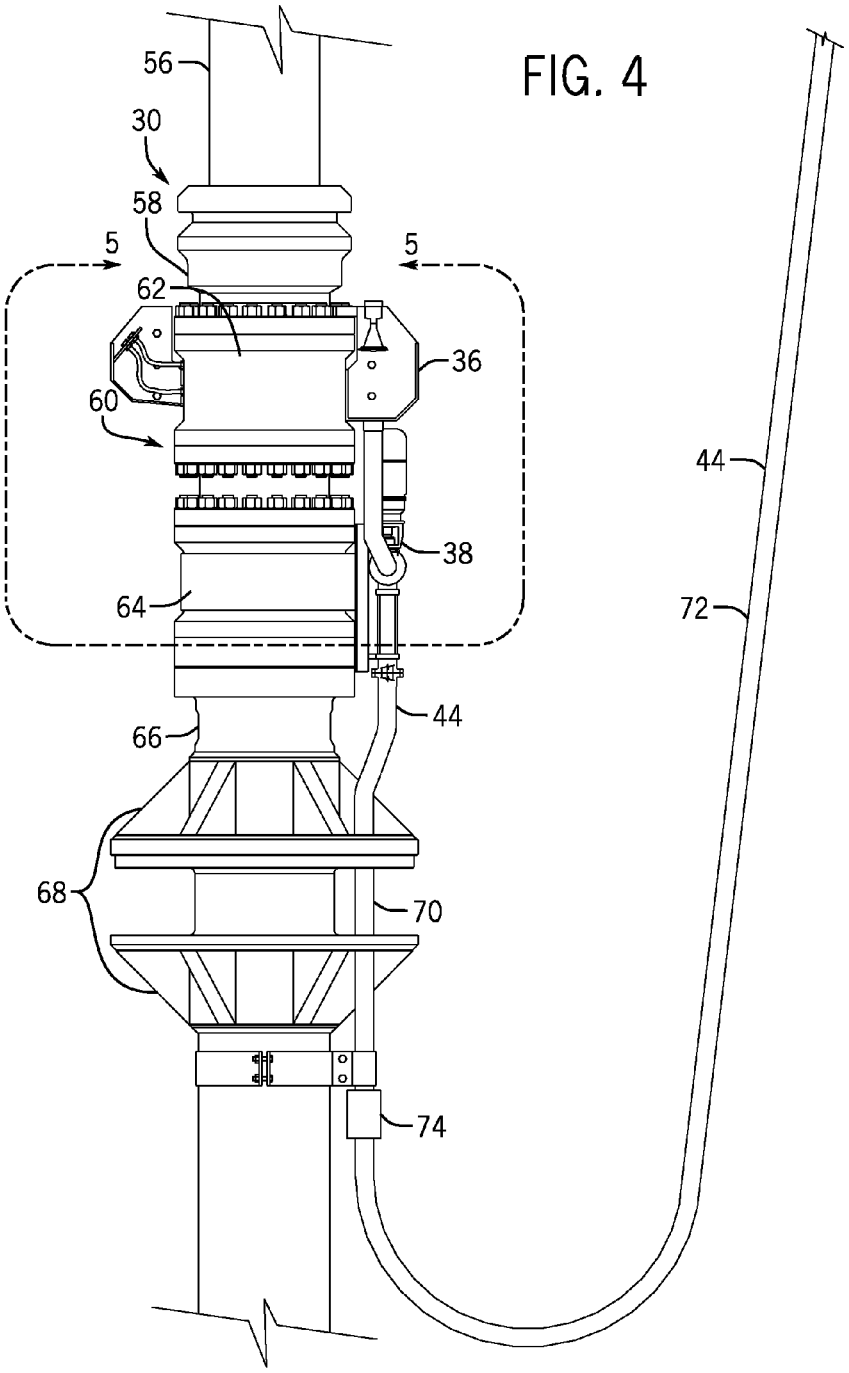
FIG. 4 is an elevational view of a drilling mud recovery system having a reservoir coupled to a telescoping joint of a marine riser in accordance with one embodiment.

In one embodiment generally depicted in FIG. 4, the telescoping joint 30 includes an inner barrel 56 disposed within an outer barrel 58. The inner barrel 56 can extend from and retract into the outer barrel 58 in response to heaving movement of a drilling rig having the surface equipment 14 with respect to the stack equipment 18 and the subsea well. The outer barrel 58 includes a seal assembly 60 mounted on a pipe 66. As presently depicted, the seal assembly 60 is a double-seal assembly having seals within an upper housing or spool 62 and a lower housing or spool 64. The outer barrel 58 includes load rings 68 intended to cooperate with a tension ring of a tensioner system to support the outer barrel 58 and the other components of the riser string to which it is connected. The reservoir 36 is installed on the telescoping joint 30 to catch drilling mud or other fluid leaking from the interface of the inner barrel 56 with the outer barrel 58 (that is, from the top of the outer barrel 58 in FIG. 4). In the presently depicted embodiment, the return conduit 44 includes a pipe 70 coupled to a hose 72 by a connector 74. Fluid within the reservoir 36 is pumped (by pump 38) through the return conduit 44 up to surface mud collection equipment (e.g., a mud tank on the drill floor of a rig).

Figure 5:
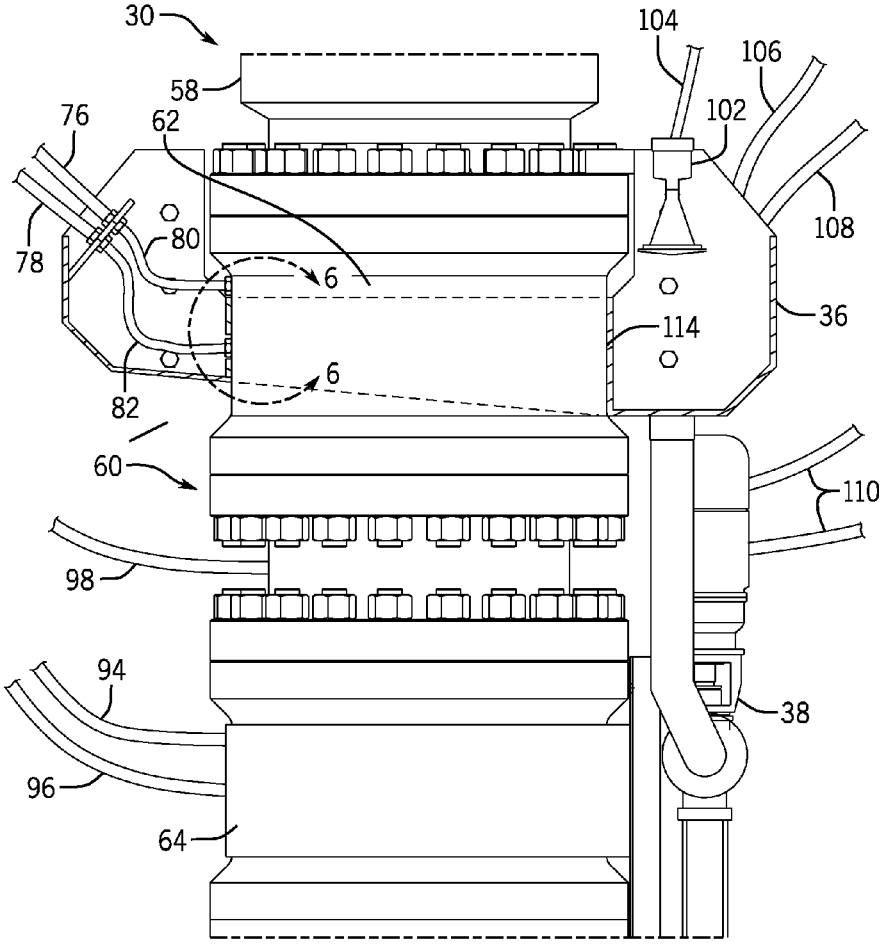
FIG. 5 is a detail view of certain components of the telescoping joint and the drilling mud recovery system depicted in FIG. 4.
Figure 6:
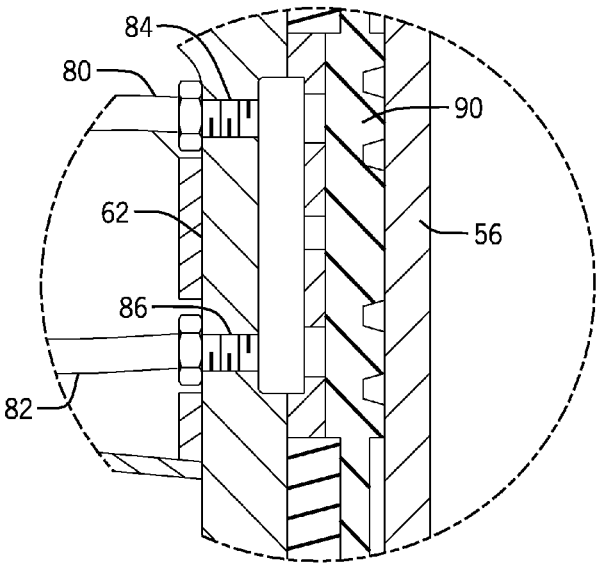
FIG. 6 is a partial cross-section showing a packer between inner and outer barrels of the telescoping joint in accordance with one embodiment.

More detailed views of the seal assembly 60 and the reservoir 36 are provided in FIGS. 5 and 6. As shown in FIG. 5, various fluid lines can be routed to the seal assembly 60 to facilitate sealing against the inner barrel 56 to inhibit leakage from the telescoping joint 30. For instance, energizing line 76 allows a fluid (e.g., compressed air) to be applied to energize a seal (packer 90 in FIG. 6) within the upper spool 62 to seal against the inner barrel 56, and test line 78 enables monitoring of the seal pressure. While the reservoir 36 could be mounted in other positions along the telescoping joint 30 in different embodiments, the reservoir 36 is depicted in FIG. 5 as mounted about a waist 114 of the upper spool 62 having a narrower diameter than the ends of the upper spool 62. To facilitate connection of the lines 76 and 78 to the upper spool 62, the reservoir 36 is here shown as including fittings 80 and 82 that are connected to ports 84 and 86 (FIG. 6) in the upper spool 62. This enables an operator to attach lines 76 and 78 to the more accessible fittings 80 and 82, rather than through the reservoir 36 to the ports 84 and 86. Another seal, which could be similar or identical to the packer 90, is disposed within the lower spool 64. As depicted, an energizing line 94 allows fluid (e.g., hydraulic fluid) to be applied to energize the seal within the lower spool 64, and a test line 96 allows monitoring of seal pressure within the lower spool 64. Fluid line 98 allows cooling fluid (e.g., water) to be routed into the seal assembly 60 to cool the seals.

In some embodiments, including that depicted in FIG. 5, the reservoir 36 includes a sensor 102 for monitoring the level of fluid within the reservoir 36. The sensor 102 could be an electric, "non-contact" level sensor or a mechanical, "float" sensor, for example. A signal cable 104 connected to the sensor 102 allows the sensor to report data on the fluid level to another component. In one embodiment, the sensor 102 transmits data to the pump 38 and the pump 38 automatically activates to pump fluid from the reservoir 36 if the fluid level exceeds a set threshold.

Additional fluid lines can be connected to the system, as well. By way of example, in the embodiment depicted in FIG. 5 fluid lines 106 and 108 route water to nozzles 132 (FIG. 7) for irrigating the reservoir 36 (e.g., to prevent caking of caught drilling mud on the reservoir 36). Further, fluid lines 110 provide control fluid to operate a motor of the pump 38. For instance, the fluid lines 110 from a drilling rig could provide hydraulic control fluid if the pump 38 includes a hydraulic motor or a control gas (e.g., compressed air) if the pump 38 includes a pneumatic motor. Or the lines 110 could be replaced with one or more electrical cables to provide power to an electric pump 38.

Figure 7:
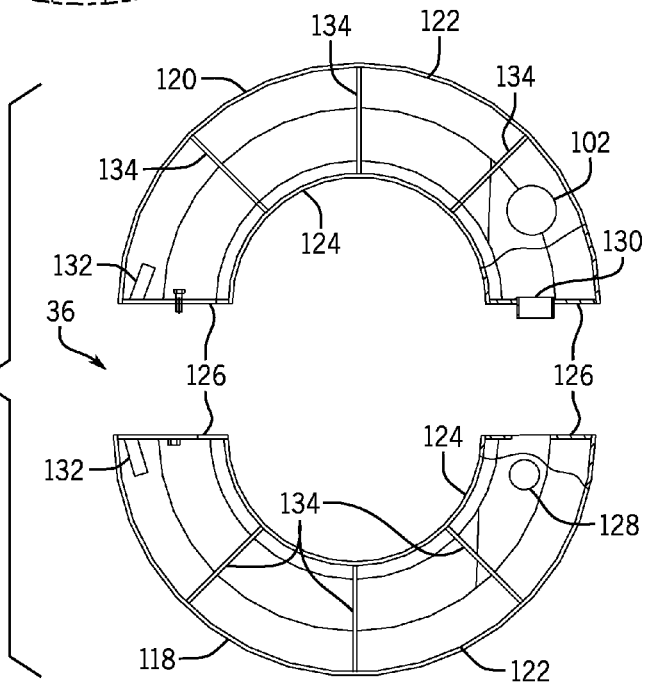
FIG. 7 is plan view depicting the reservoir of FIG. 4 as having multiple pieces that facilitate assembly of the reservoir about the marine riser in accordance with one embodiment.
Figure 8:
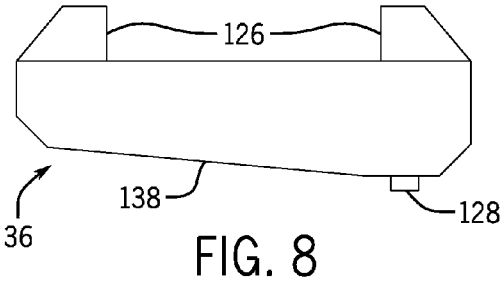
FIG. 8 is an elevational view of the reservoir of FIG. 7.

In some embodiments, including that of FIG. 5, the reservoir 36 is positioned about the waist 114 of the upper spool 62. It is noted, however, that the reservoir 36 could be positioned elsewhere, such as about the lower spool 64 or about the outer barrel 58 above the double-seal assembly 60. To facilitate attachment of the reservoir 36, in some embodiments the reservoir 36 is formed from multiple pieces that can be assembled about the waist 114 (or some other portion of the apparatus). One example of such a reservoir 36 is depicted in FIGS. 7 and 8.

In this example, the reservoir 36 is divided into two portions 118 and 120. Each includes an outer edge 122, an inner edge 124, and end walls 126. The two portions 118 and 120 can be assembled about the outer barrel 58 (e.g., at waist 114 of the upper spool 62) to enable the reservoir 36 to catch leaking fluid from the telescoping joint 30. The two portions 118 and 120 may be secured to one another with fasteners or in any other suitable manner. As generally noted above, caught drilling mud can be pumped from the reservoir via a drain 128 and returned to the surface (either by routing the fluid directly to the surface or by reintroducing the fluid into the telescoping joint 30). A fluid transfer port 130 allows fluid to pass between the two portions 118 and 120. As depicted in FIG. 7, the reservoir 36 includes nozzles 132 for spraying water (or some other fluid) into the reservoir to flush caught fluids and particulates (e.g., drill cuttings) and inhibit caking of drilling mud. Additional devices, such as members 134, may be provided for structural reinforcement of the reservoir 36. And as shown in FIG. 8, the reservoir 36 includes a sloped base 138 so that caught fluid flows toward the drain 128.

Figure 9:
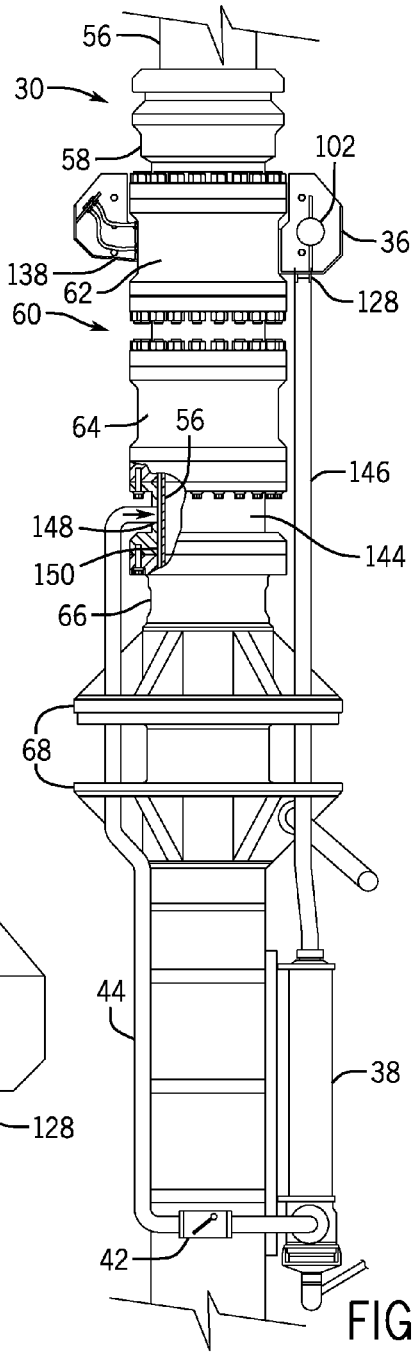
FIG. 9 is an elevational view of a drilling mud recovery system having a reservoir coupled to a telescoping joint of a marine riser, in which drilling mud is drawn from the reservoir and reintroduced into the telescoping joint through a port in an adapter spool in accordance with one embodiment.

Another embodiment of a mud recovery system is depicted in FIG. 9. The system depicted in FIG. 9 is similar to that depicted in FIG. 3. But rather than returning fluid caught within the reservoir 36 directly to the surface, in the embodiment depicted in FIG. 9 the fluid caught within the reservoir 36 is routed through the return conduit 44 back into the telescoping joint 30. More specifically, the mud recovery system of FIG. 9 includes an adapter spool 144 to enable the fluid caught within the reservoir 36 to be recycled directly into the telescoping joint 30. Fluid is pumped from the reservoir 36 through piping 146 of the return conduit 44 and into a port 148 of the adapter spool 144. This allows the recycled fluid to enter the annulus 150 between the inner barrel 56 and the outer barrel 58 and be combined with other fluid already present in the annulus 150. The return conduit 44 in this embodiment includes the check valve 42, which inhibits flow of drilling mud or other fluids out of the annulus 150 through the port 148.

In the depicted embodiment, the adapter spool 144 provides an entry point into the outer barrel 58 for the fluid recycled from the reservoir 36. But the recycled fluid could be routed into the outer barrel 56 in other ways. For instance, the adapter spool 144 could be omitted and a port could be formed in another portion of the outer barrel 56. Additionally, the fluid could instead be routed into another portion of the riser, such as into a riser joint 24 below the telescoping joint 30. While suitable alternatives to the adapter spool 144 may be used in accordance with the present techniques, the inclusion of the adapter spool 144 may facilitate retrofitting of existing telescoping joints with mud recovery systems in that it may be easier for an operator to add the adapter spool 144 than to form a port through the body of an existing telescoping joint.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A fluid recovery system comprising:

a telescoping joint of a marine riser, the telescoping joint having an inner barrel and an outer barrel configured to extend and retract with respect to one another when installed as part of the marine riser;

a drip pan coupled to the outer barrel to enable the drip pan to catch fluid leaking from the telescoping joint between the inner barrel and the outer barrel;

a pump mounted on the marine riser; and a return conduit, wherein the pump and the return conduit are coupled to enable the pump to pump caught fluid from the drip pan directly back into the telescoping joint via the return conduit.

2. The fluid recovery system of claim 1, wherein the outer barrel includes at least one seal assembly having a seal disposed inside of a spool and adapted to seal against the inner barrel.

3. The fluid recovery system of claim 2, wherein the drip pan is attached about an outer surface of the spool of the at least one seal assembly.

4. The fluid recovery system of claim 3, wherein the drip pan is attached about a waist of the spool having a narrower diameter than ends of the spool.

5. The fluid recovery system of claim 2, wherein the at least one seal assembly includes a double-seal assembly.

6. The fluid recovery system of claim 2, wherein the drip pan includes fittings that enable connection of hoses and routing of fluid into the spool via the drip pan.

7. The fluid recovery system of claim 1, wherein the drip pan includes at least one nozzle that enables irrigation within the drip pan.

8. The fluid recovery system of claim 1, comprising a level detector that enables reading of a level of caught fluid within the drip pan.

9. The fluid recovery system of claim 8, wherein the pump is configured to activate in response to the level of the caught fluid within the drip pan read by the level detector.

10. The fluid recovery system of claim 1, wherein the pump and the return conduit are coupled to enable the pump to pump caught fluid from the drip pan back into the outer barrel of the telescoping joint via the return conduit.

11. The fluid recovery system of claim 10, wherein the outer barrel includes an adapter spool and the return conduit is coupled to a port in the adapter spool to enable caught fluid to be pumped from the drip pan, through the return conduit, and through the port to return the caught fluid into the outer barrel.

12. A fluid recovery system comprising:

a reservoir having an inner edge that is defined by an opening through the reservoir that enables installation of the reservoir about a telescoping joint to catch drilling fluid leaking from the telescoping joint; and an adapter spool having a fluid port and configured to be installed as part of the telescoping joint and in fluid communication with the reservoir to enable the drilling fluid caught by the reservoir to be recycled by directly returning the drilling fluid into the telescoping joint through the fluid port of the adapter spool.

13. The fluid recovery system of claim 12, wherein the reservoir is formed of multiple pieces that enable the reservoir to be assembled about the telescoping joint, the multiple pieces including abutting end walls with at least one fluid transfer port that permits drilling fluid caught within one of the multiple pieces to pass to another of the multiple pieces through the end walls when the multiple pieces are assembled about the telescoping unit.

14. The fluid recovery system of claim 12, comprising a fluid conduit and a pump configured to be installed between a drain of the reservoir and the fluid port of the adapter spool to enable drilling fluid caught in the reservoir to be pumped into the fluid port of the adapter spool.

15. The fluid recovery system of claim 12, comprising the telescoping joint.

16. A method comprising:

conveying drilling mud through a telescoping joint of a marine riser connected to an offshore drilling rig;

catching, within a reservoir on the telescoping joint, drilling mud that has escaped the telescoping joint by passing between an inner barrel and an outer barrel of the telescoping joint; and recycling the drilling mud caught within the reservoir by routing the drilling mud caught within the reservoir directly back into the telescoping joint.

17. The method of claim 16, wherein routing the drilling mud caught within the reservoir directly back into the telescoping joint includes routing the drilling mud caught within the reservoir into the outer barrel of the telescoping joint.

18. The method of claim 17, wherein routing the drilling mud caught within the reservoir into the outer barrel of the telescoping joint includes routing the drilling mud caught within the reservoir through a port in an adapter spool of the telescoping joint.

19. The method of claim 16, wherein routing the drilling mud caught within the reservoir includes pumping the drilling mud caught within the reservoir from the reservoir into an annular space between the inner barrel and the outer barrel of the telescoping joint.

20. The method of claim 16, comprising detecting that the drilling mud caught within the reservoir exceeds a threshold amount and, in response, automatically activating a pump to drain the drilling mud caught within the reservoir and return it to the telescoping joint.

* * * * *